United States Patent [19]

Cadeo

[11] Patent Number: 4,786,183

[45] Date of Patent: Nov. 22, 1988

[54] MIXING APPARATUS

[75] Inventor: Angelo Cadeo, Rothrist, Switzerland

[73] Assignee: Miteco AG, Zofingen, Switzerland

[21] Appl. No.: 843,780

[22] Filed: Mar. 25, 1986

[30] Foreign Application Priority Data

Apr. 3, 1985 [CH] Switzerland ..... 1453/85

[51] Int. Cl.[4] ..... B01F 5/12

[52] U.S. Cl. ..... 366/265; 366/263; 366/296; 416/184; 416/224

[58] Field of Search ..... 366/262, 263, 265, 293, 366/294, 296, 177; 137/13, 896; 416/184, 224

[56] References Cited

U.S. PATENT DOCUMENTS 3,252,690 5/1966 Martin ..... 366/296 X 3,942,766 3/1974 Lage ..... 137/896

OTHER PUBLICATIONS

Lueger, "Lexikon der Technik" (4th edition), vol. 1, pp. 587–589 and 521, 522, date unknown.

*Primary Examiner*—Timothy F. Simone

*Attorney, Agent, or Firm*—Shenier & O'Connor

[57] ABSTRACT

The mixing apparatus has a plurality of pump impellers having one common axis and extending parallel to each other. Immediately adjacent pump impellers have opposite directions of rotation. The blading of the pump impellers is such that the currents of the mediums exiting the pump impellers have an as large as possible peripheral component. The medium currents exiting the adjacent pump impellers and having opposite senses of rotation are guided together and generate at the mutual point of contact an extremely high turbulence because the peripheral components of the exiting rotating currents of the mediums are directed oppositely to each other and eliminate each other practically immediately.

2 Claims, 3 Drawing Sheets

MIXING APPARATUS

BACKGROUND OF THE INVENTION

1. Field of the Invention

The present invention relates to a mixing apparatus for intermixing at least one flowing medium and in which at least two component currents of the flowing medium are led against each other such to generate a turbulent current.

In a great many of chemical and physical processes it is possible to utilize as strongly as possible turbulences in the flowing mediums to reach a specific object. It is generally known that the turbulence of a current grows and rises together with the amount of force of an oscillating movement extending laterally relative to the main stream direction. It is, for instance, generally known to direct a controlling current to extend perpendicularly or laterally relative to a main current and to direct such controlling current against the main current such to generate at the point where these two currents meet a change from a laminar current to a turbulent current. At this mentioned point where the two currents meet or intersect, respectively, the pressure decreases rapidly and the flowing mediums "explode" laterally relative to the direction of flow. (See in this respect "Lueger, Lexikon der Technik", fourth edition, Volumes 1 and 14, Pages 587 to 589 and Pages 521, 522, respectively.)

2. Description of the Prior Art

In order to generate an as large as possible turbulence in flowing mediums it has already been proposed to induce a rotating movement in such mediums and to guide the two rotating mediums together, such that the point of transition to the turbulence appears at the component currents directed oppositely to each other. The two rotating currents of such medium have been generated by not rotating guide wheels. It has, however, been experienced that such an apparatus is not in a position to generate economically a turbulence of a desired magnitude.

SUMMARY OF THE INVENTION

Hence, it is a general object of the present invention to provide a mixing apparatus, by means of which turbulences of a large magnitude can be generated economically.

A further object is to provide a mixing apparatus comprising at least two pump impellers arranged parallel and coaxially relative to each other, any two directly adjacent pump impellers arranged for counterrotation relative to each other, and each pump impeller allocated to one of the component currents.

It is a further object of the present invention to provide a mixing apparatus which comprises two pump impellers arranged parallel and coaxially relative to each other and for counterrotation relative to each other, each pump impeller allocated to one of the component currents.

Yet a further object of the present invention is to provide a mixing apparatus comprising two pump impellers arranged parallel and coaxially relative to each other and for counterrotation relative to each other, each pump impeller allocated to one component current and mounted to a driving shaft, which driving shafts are located at the respective sides of said impellers facing away from each other.

By means of the invention it is possible to generate extremely high peripheral speeds of the component currents leaving the pump impellers or exiting the pump impellers, respectively, which component currents are directed against each other and practically eliminate themselves mutually immediately on impact such that at this point of transition to a turbulence an extremely high turbulence is generated.

BRIEF DESCRIPTION OF THE DRAWINGS

The present invention will be more fully understood by the reference to the following detailed description thereof, when read in conjunction with the attached drawings, wherein.

DESCRIPTION OF THE PREFERRED EMBODIMENTS

Figure 1:
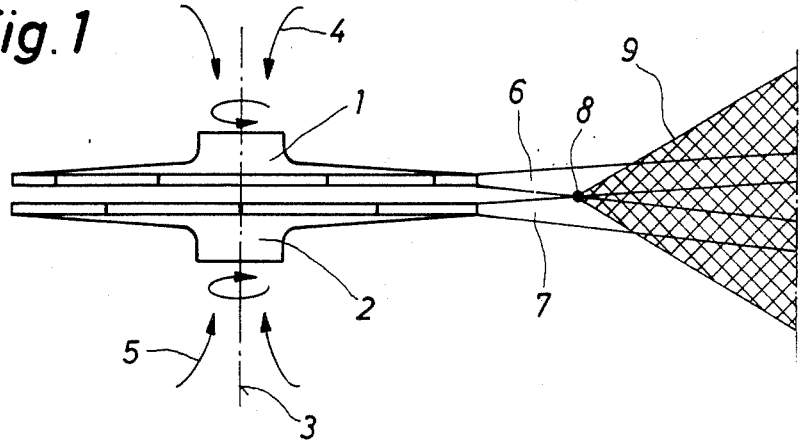
FIG. 1 illustrates schematically two pump impellers including the point of transition to the turbulence and the area covered by a fluid being mixed.

FIG. 1 illustrates rather schematically two pump impellers 1 and 2 which are arranged parallel and coaxially relative to each other. Both pump impellers 1 and 2 rotate around one common axis 3, however in a counterrotating arrangement. A first component current flows in direction of the arrow 4 towards the pump impeller 1 and a second component current flows in direction of the arrow 5 towards the second pump impeller 2. The first component current exits the pump impeller 1 in form of a rotating disk shaped body of the medium and the second component current 7 exits also in shape of a rotating disk shaped body of the medium out of the pump impeller 2. The two disk shaped bodies of the mediums 6 and 7 counterrotate relative to each other. Preferably the two pump impellers 1 and 2 are of a same design (obviously taking the respective directions of rotation into consideration) and accordingly have apart from the sense of rotation the same hydrodynamic characteristics. The two rotating disk shaped bodies 6 and 7 of the medium having oppositely directed senses of rotation contact each other at the point of transition 8, at which the two peripheral components of direction of the two disk shaped fluid bodies directed against each other contact each other, meet each other and eliminate each other practically immediately. The two disk shaped liquid bodies 6 and 7 incorporate small radial speed components, which determine the feed output or feed capacity, respectively, of the pump impellers. Due to the sudden elimination of the tangential speed components directed against each other, the liquid particles begin to carry out oscillating lateral movements which generate in the area 9 of the liquid being mixed an extremely high turbulence.

Figure 2:
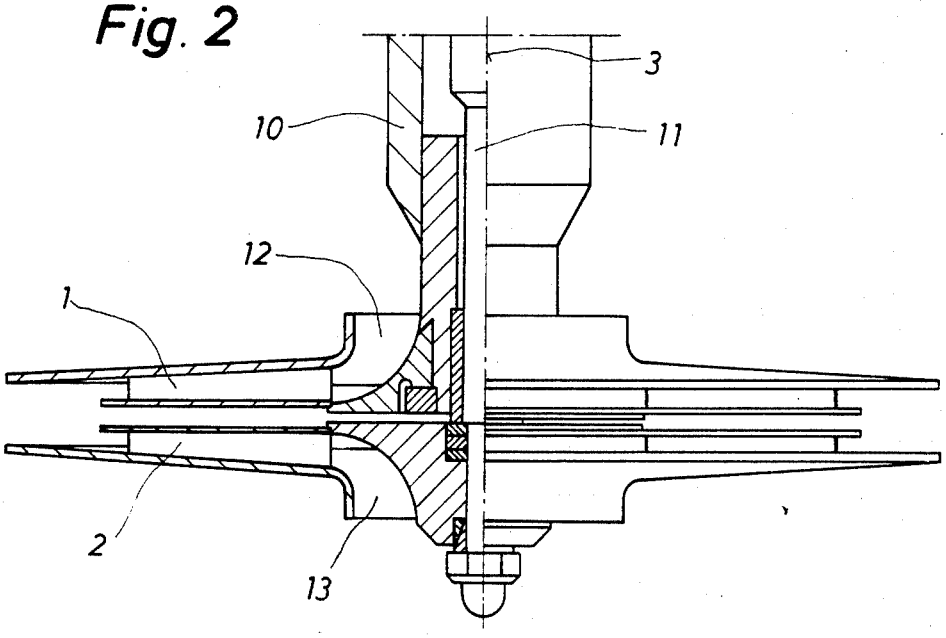
FIG. 2 illustrates an embodiment encompassing two pump impellers having an inner shaft and a hollow shaft, respectively.

In FIG. 2 the two pump impellers 1 and 2 are illustrated somewhat more in detail. Pump impeller 1 is supported by a hollow shaft 10, and the pump impeller 2 is supported by an inner shaft 11, which is received in the hollow shaft 10. The pump impeller 1 comprises a pump intake or suction section, respectively, 12, for the component current 4, and the pump impeller 2 comprises an intake or suction section, respectively, 13, for the component current 5. The two pump impellers 1 and 2 rotate around the axis 3 in an opposite direction of rotation.

Figure 3:
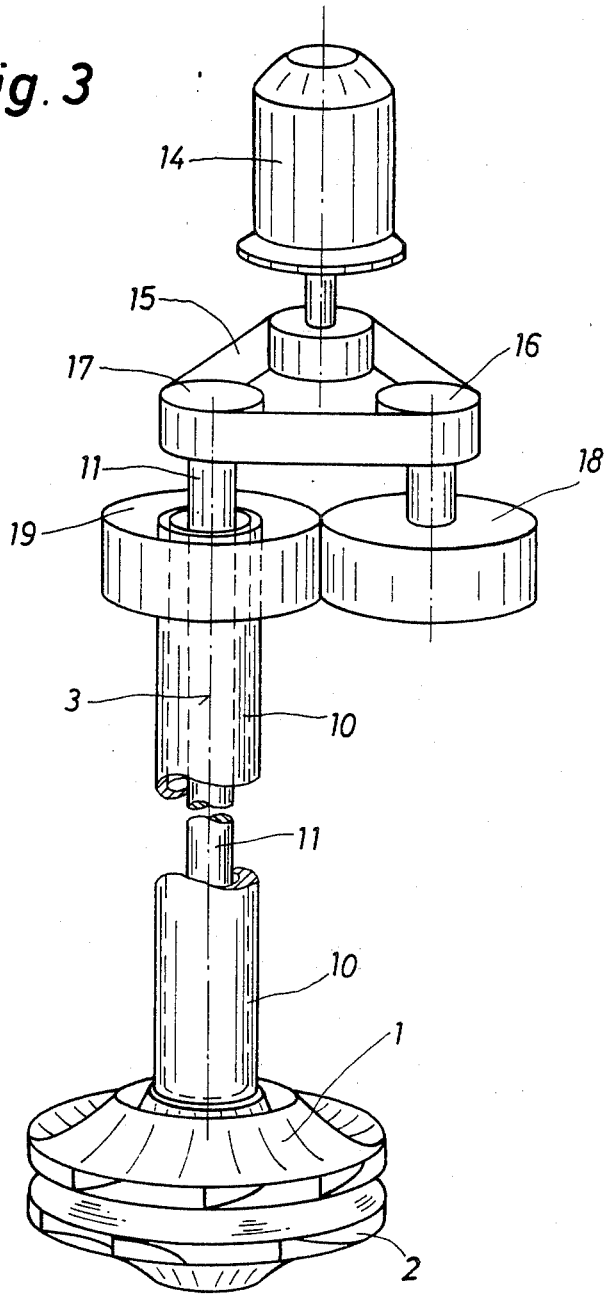
FIG. 3 is a schematic perspective view of a mixing apparatus having one single drive motor.

In the embodiment designed in FIG. 3 the two pump impellers 1 and 2 are counter-rotatingly driven by one single drive motor 14. As has been mentioned above, the pump impeller 1 is supported by the hollow shaft 10 and the pump impeller 2 by the inner shaft 11. The drive motor 14 drives via a belt 15 pinions 16 and 17. Pinion 17 is mounted for rotation to the inner shaft 11. Pinion 16 is mounted for rotation to a wheel 18, which meshes with a wheel 19, which wheel 19 in turn is mounted for rotation to the hollow shaft 10. By this design the two shifts 10 and 11 are driven counter-rotatingly.

Figure 4:
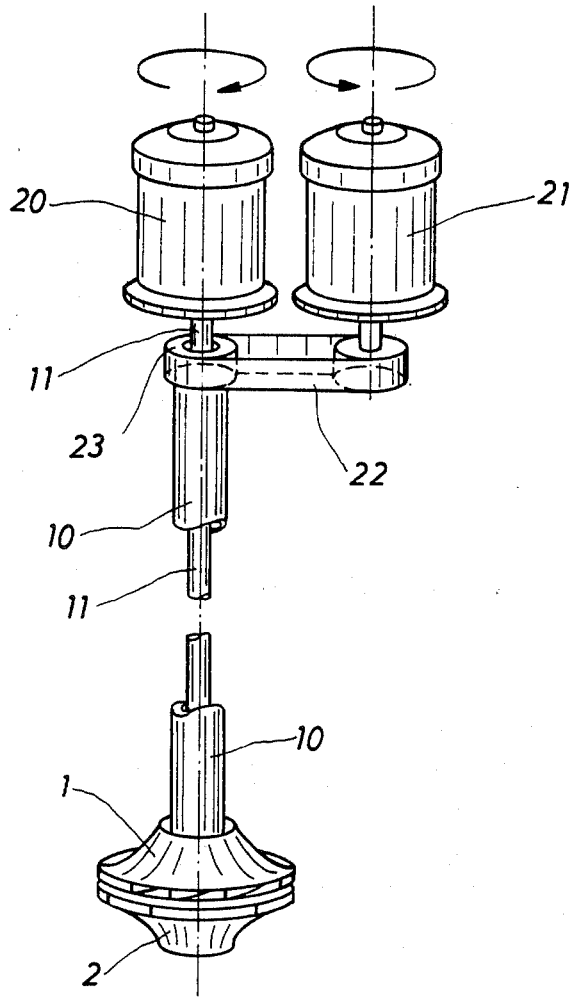
FIG. 4 illustrates a mixing apparatus having two drive motors, one each for one pump impeller.

The two pump impellers 1 and 2 of the embodiment illustrated in FIG. 4 are counter-rotatingly driven by two drive motors 20 and 21. Motor 20 drives directly the inner shaft 11, which supports the pump impeller 2, and the motor 21 drives via a further belt 22 a belt pulley 23 mounted for rotation onto the hollow shaft 10. The motors 20 and 21 have opposite directions of rotation.

Figure 5:
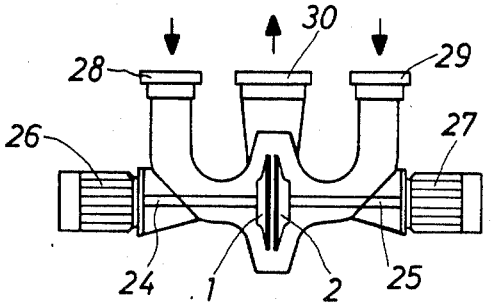
FIG. 5 a further preferred embodiment having two drive motors and two drive shafts for the impellers, which drive shafts are located on the respective sides of the impellers facing away from each other.

Referring now to FIG. 5 there is disclosed an embodiment, in which the pump impeller 1 is seated on a shaft 24 and the pump impeller 2 on a shaft 25. The two drive shafts 24 and 25 which extend coaxially relative to each other and are allocated to the pump impellers 1 and 2, respectively, are located, accordingly, on the outer sides of the pump impeller, i.e. on the sides facing away from each other. A motor 26 drives shafts 24 and accordingly pump impeller 1 and motor 27 drives shaft 25 and accordingly pump impeller 2. An intake stub 28 leads to the pump impeller 1 and an intake stub 29 leads to the pump impeller 2. The two flowing mediums which have been guided against each other exit via the exhaust stub 30.

Accordingly to further embodiments which come to mind more than two pump impellers may be provided, in which case any two immediately adjacent located pump impellers have opposite directions of rotation. Having, for instance, three such pump impellers it is possible to produce or generate three component currents, each having a disk shaped configuration and whereby any two immediately adjacent disk shaped bodies have opposite senses of rotation, and which disk shaped bodies are brought together at the point of transition. In the various illustrated embodiments the pump impellers 1 and 2 are designed as centrifugal impellers. If the pump impellers 1 and 2 are designed with forwardly bent rotor blades, the peripheral components of the velocity of the exiting disk shaped liquid bodies 6 and 7 can be strongly increased. By correspondingly choosing the speed of the pump impellers 1 and 2 the peripheral component of the velocity (tangential velocity) of the two disk shaped liquid bodies 6 and 7 can be chosen correspondingly large.

While there are shown and described present preferred embodiments of the invention, it is to be distinctly understood that the invention is not limited thereto, but may be otherwise variously embodied and practiced within the scope of the following claims.

I claim:

1. A mixing apparatus for intermixing at least one flowing medium and in which at least two component currents (4,5) of the flowing medium are led against each other so as to generate a turbulent current (9), said mixing apparatus comprising at least two centrifugal pump impellers arranged in parallel and coaxial relationship, any two directly adjacent pump impellers (1,2) arranged for counter-rotation relative to each other, and each pump impeller allocated to one of said component currents so that a first laminar component current exits the first pump impeller in the form of a rotating disk shaped body (6) of the medium and a second laminar component current exits the second pump impeller in the shape of a rotating disk shaped body (7) of the medium with the two disk shaped bodies of the medium contacting each other outside said first and second impellers at a point of transition (8) to change the two laminar currents to a turbulent current in a region (9) outside the two impellers, said pump impellers comprising forwardly bent rotor blades.

2. The mixing apparatus of claim 1, in which any two directly adjacent pump impellers are identical relative to their delivery capacity and peripheral speed of the emerging component currents.

* * * * *

UNITED STATES PATENT AND TRADEMARK OFFICE

CERTIFICATE OF CORRECTION

PATENT NO. : 4,786,183

DATED : November 22, 1988

INVENTOR(S) : Angelo Cadeo

It is certified that error appears in the above-identified patent and that said Letters Patent is hereby corrected as shown below:

On the title page, Item [73] should read

-- Assignee: Miteco AG, Zofingen, Switzerland, part interest --.

Signed and Sealed this

Ninth Day of May, 1989

*Attest:*

DONALD J. QUIGG

*Attesting Officer*

*Commissioner of Patents and Trademarks*